US007992624B2

(12) United States Patent
Huang

(10) Patent No.: US 7,992,624 B2
(45) Date of Patent: Aug. 9, 2011

(54) HEAT SINK MODULE

(76) Inventor: Tsung-Hsien Huang, I-Lan-Hsien (TW)

( * ) Notice: Subject to any disclaimer, the term of this patent is extended or adjusted under 35 U.S.C. 154(b) by 274 days.

(21) Appl. No.: 12/324,872

(22) Filed: Nov. 27, 2008

(65) Prior Publication Data

US 2010/0126697 A1 May 27, 2010

(51) Int. Cl.
*F28F 7/00* (2006.01)

(52) U.S. Cl. ..... 165/80.3; 165/182; 362/294; 362/373

(58) Field of Classification Search ..... 362/373, 362/294, 249.02; 165/80.3, 182
See application file for complete search history.

(56) References Cited

U.S. PATENT DOCUMENTS

| | | | | |
|---|---|---|---|---|
| 7,631,987 | B2 * | 12/2009 | Wei | 362/294 |
| 2009/0016062 | A1 * | 1/2009 | Lee et al. | 362/294 |
| 2009/0147520 | A1 * | 6/2009 | Liu et al. | 362/294 |

FOREIGN PATENT DOCUMENTS

JP 11114730 A * 4/1999

* cited by examiner

*Primary Examiner* — Evan Dzierzynski
(74) *Attorney, Agent, or Firm* — Pai Patent & Trademark Law Firm; Chao-Chang David Pai

(57) ABSTRACT

A heat sink module includes a heat transfer tube, a plurality of radiation fins respectively riveted to locating grooves around the periphery of the heat transfer tube, and a heat transfer panel fastened to the bottom side of the heat transfer tube and the radiation fin set and kept in contact with a heat source, such as a CPU or a light emitting unit of a LED lamp for transferring heat from the heat source to the radiation fins for quick dissipation.

9 Claims, 8 Drawing Sheets

HEAT SINK MODULE

BACKGROUND OF THE INVENTION (a) Field of the Invention

The present invention relates to heat sink technology and more particularly to a heat sink module, which comprises a heat transfer tube, a plurality of radiation fins radially arranged around the periphery of the heat transfer tube and fastened to one another, and a heat transfer panel affixed to the bottom side of the heat transfer tube for direct contact with a heat source to transfer heat to the radiation fins for quick dissipation.

(b) Description of the Prior Art

Many heat sink modules are commercially available. A commonly used heat sink is comprised of a heat transfer base panel and a plurality of radiation fins arranged on the top side of the heat transfer base panel. The heat transfer base panel and the radiation fins are made from aluminum or copper. The radiation fins are bonded to the heat transfer base panel by means of heat fusion with a solder paste or bonding agent. If the heat transfer base panel and the radiation fins are respectively made from different metal materials, a nickel plating treatment is necessary before bonding. This heat sink module fabrication procedure is complicated, resulting in high manufacturing cost and low yield rate. Further, nickel plating causes environmental contamination.

Further, LED projector lamps have a low power consumption characteristic. However, a LED projector lamp has low working temperature. The performance of a LED projector lamp has a great concern with its heat dissipation efficiency. Therefore, it is important to improve the heat dissipation efficiency of a LED projector lamp.

SUMMARY OF THE INVENTION

The present invention has been accomplished under the circumstances in view. The heat sink module of the present application comprises a heat transfer tube, a radiation fin set, and a heat transfer panel. The radiation fin set comprises a plurality of radiation fins that are radially riveted to the periphery of the heat transfer tube and then fastened to one another. The heat transfer panel is affixed to the bottom side of the heat transfer tube. During application, the heat transfer panel is kept in close contact with the heat source to transfer heat from the heat source to the radiation fins for quick dissipation.

The heat sink module is practical for use with a LED lamp to keep the heat transfer panel in direct contact with the light emitting unit of a series of light emitting diodes of the LED lamp for quick dissipation of heat from the light emitting diodes.

Further, each radiation fin comprises a plurality of retaining lugs at the top and bottom sides. By means of fastening the retaining lugs of one radiation fin to the retaining lugs of another radiation fin, the radiation fins are fastened together. Further, in a preferred embodiment, each radiation fin has its bottom retaining lugs arranged at different elevations to fit the stepped configuration of the heat transfer panel for direct contact, enhancing heat transfer efficiency.

According to still another aspect of the present invention, each radiation fin has its inner end ribbed into a ribbed end edge for quick fastening to one respective locating groove on the periphery of the heat transfer tube to increase the contact area between the heat transfer tube and the radiation fins for quick dissipation of heat.

According to still another aspect of the present invention, each radiation fin has its inner end ribbed into a ribbed end edge having a L-shaped, triangular, inverted T, or scrolled configuration for quick mounting in one respective locating groove on the periphery of the heat transfer tube to increase the contact area between the heat transfer tube and the radiation fins for quick dissipation of heat.

According to still another aspect of the present invention, the heat transfer tube can be directly extruded from a metal material by means of a metal extrusion process, thus simplifying the fabrication and lowering the heat transfer tube manufacturing cost.

DETAILED DESCRIPTION OF THE PREFERRED EMBODIMENTS

Figure 1:
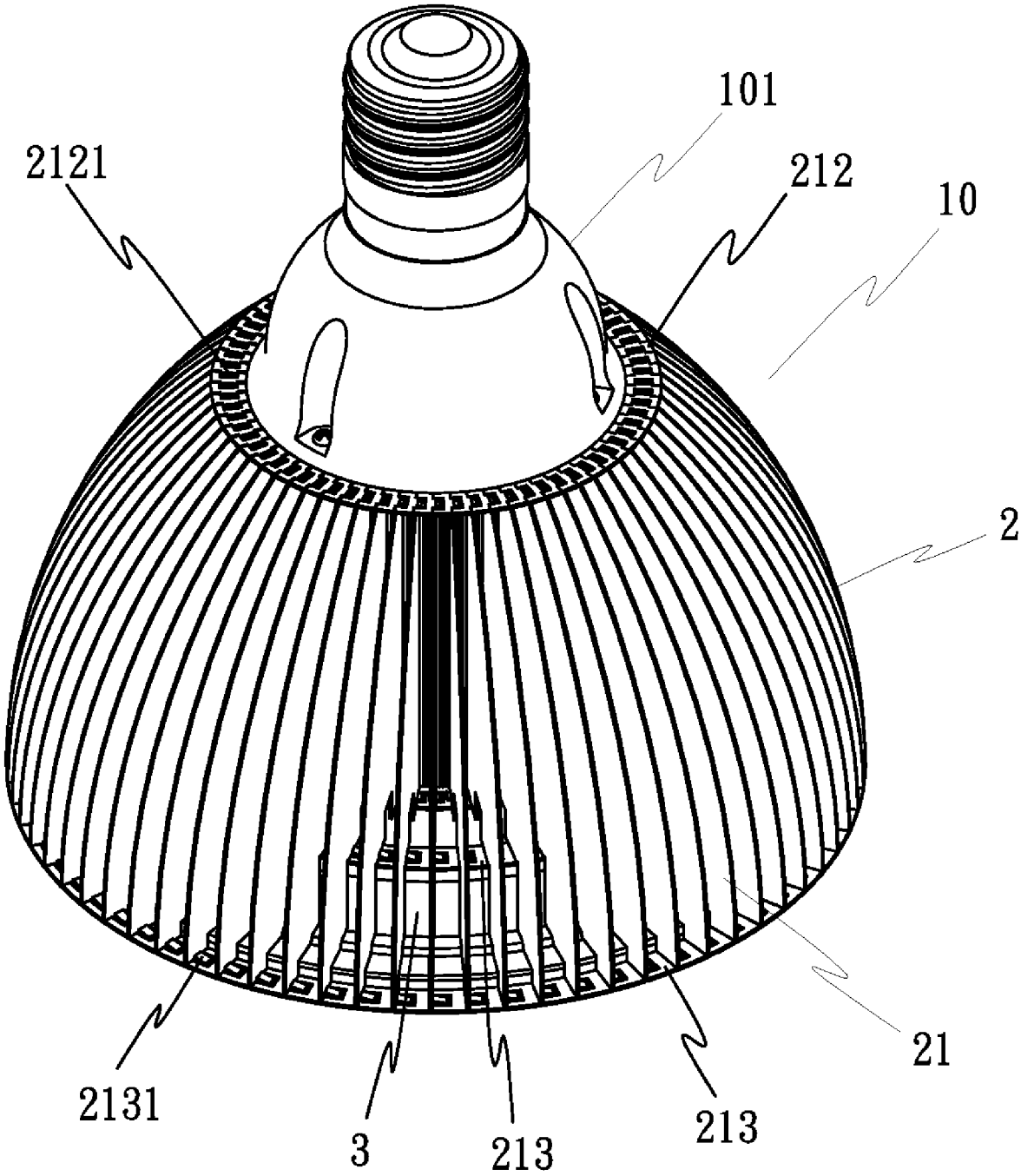
FIG. 1 is an elevational view of an LED lamp mounted with a heat sink module according to the present invention.
Figure 2:
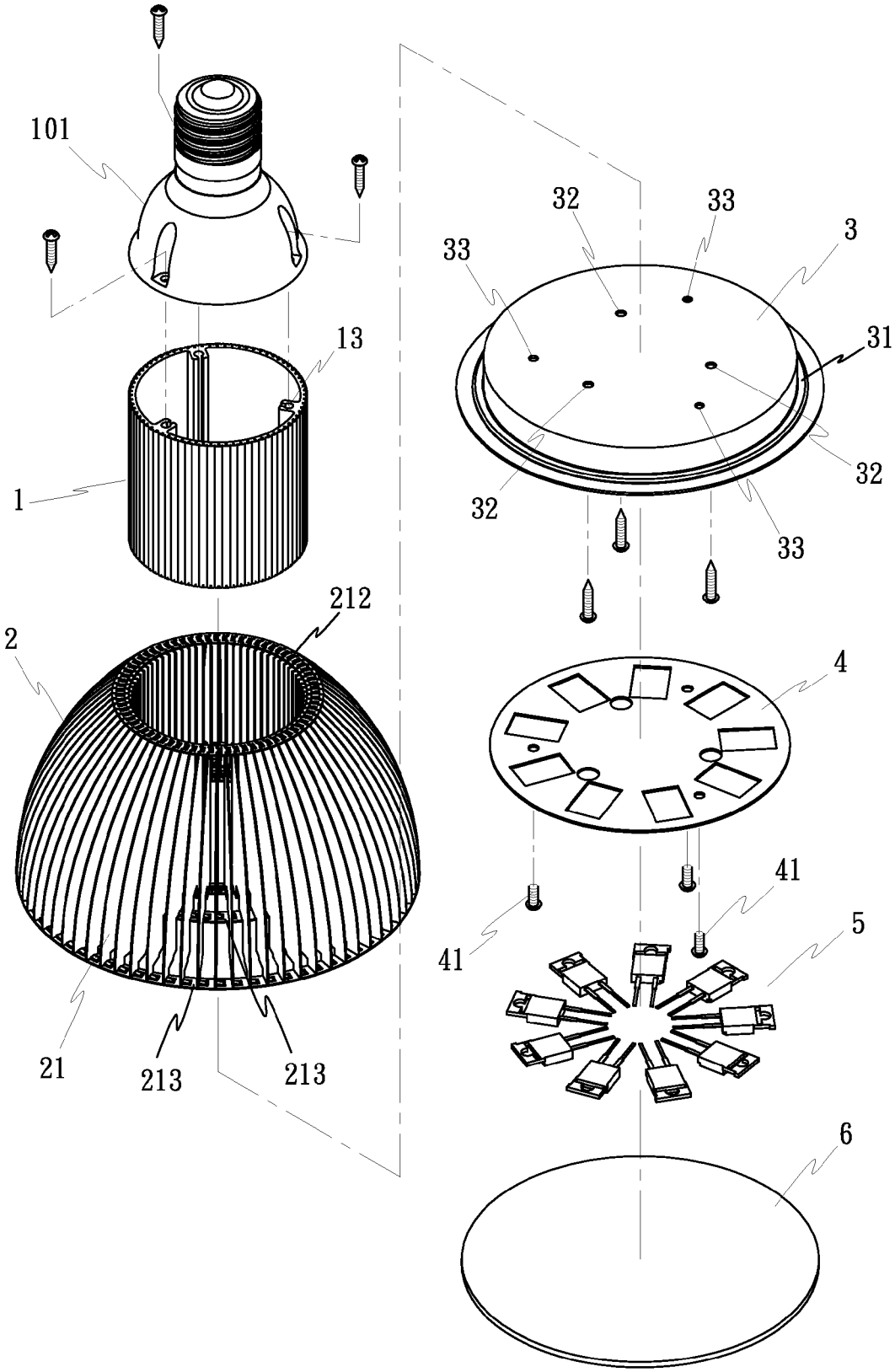
FIG. 2 is an exploded view of the LED lamp shown in FIG. 1.
Figure 3:
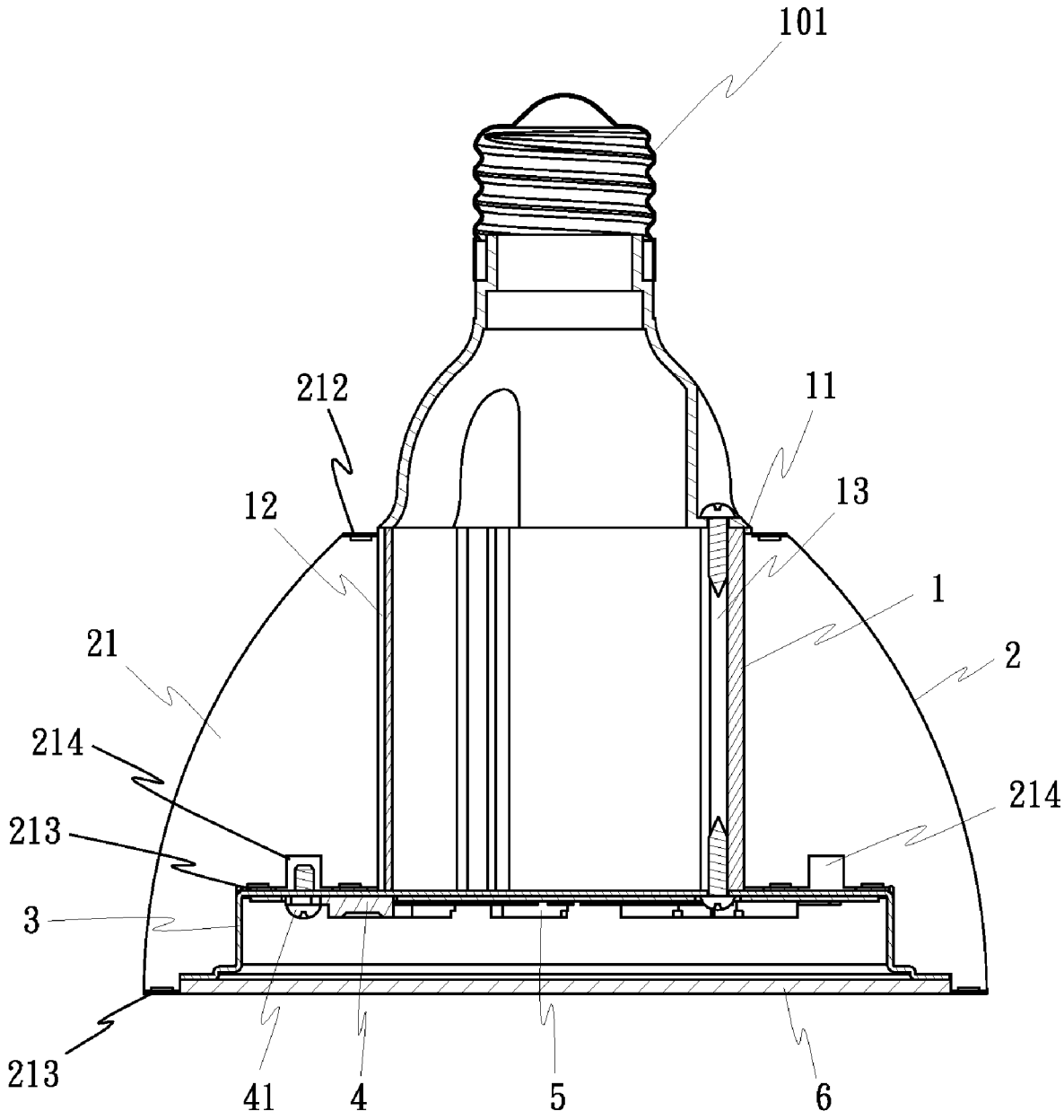
FIG. 3 is a sectional view of the LED lamp shown in FIG. 1.

Referring to FIGS. 1~3, a spherical heat sink module for a LED lamp 10 is shown. It is to be understood that the spherical heat sink module is applicable to other objects or in different fields. For example, the spherical heat sink module can be used to carry heat from a heat source in a computer (such as CPU). As illustrated, the spherical heat sink module comprises a heat transfer tube 1, a radiation fin set 2, and a heat transfer panel 3. These component parts can be made from copper, aluminum, or any of a variety of other heat conducting metals.

Figure 4:
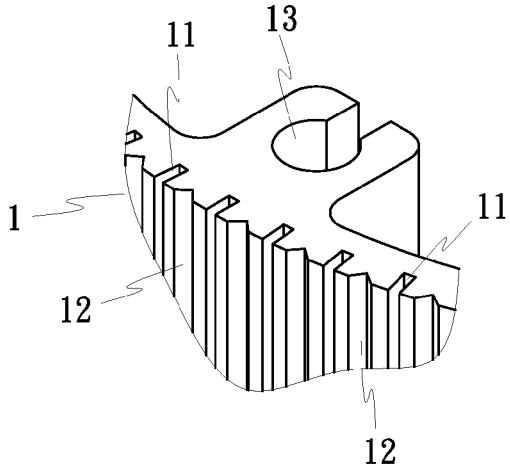
FIG. 4 is an enlarged view of a part of the heat transfer tube of the heat sink module according to the present invention.

The heat transfer tube 1, as shown in FIGS. 2 and 4, a hollow tube having a plurality of locating grooves 11 and a plurality of V-grooves 12 alternately arranged around the periphery and longitudinally extending through the top and bottom ends, a plurality of mounting holes 13 equiangularly spaced around the inside wall. The locating grooves 11 are adapted to receive the radiation fins 21 of the radiation fin set 2 respectively (see FIGS. 5 and 6). After the radiation fins 21 are inserted into the locating grooves 11, the V-grooves 12 are deformed, thereby firmly securing the radiation fins 21 to the heat transfer tube 1. The mounting holes 13 at the top side of the heat transfer tube 1 are for the mounting of the lamp holder 101 of the LED lamp 10 (see FIG. 2).

Figure 5:
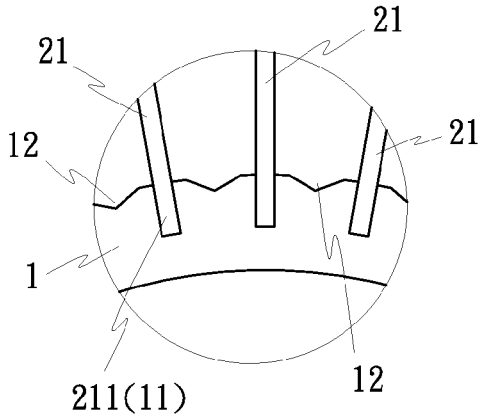
FIG. 5 is a schematic view of a part of the present invention, showing connection between the radiation fins and the heat transfer tube.

The radiation fin set 2 comprises a plurality of radiation fins 21 radially arranged together to show a substantially semi-spherical configuration (see FIGS. 2 and 5). Each radiation fin 21 has an inner end 211 press-fitted into one respective locating groove 11 of the heat transfer tube 1. By means of deforming the V-grooves 12 of the heat transfer tube 1 after inserting the inner ends 211 of the radiation fins 21, the radiation fins 21 are riveted to the periphery of the heat transfer tube 1.

The heat transfer panel 3 is affixed to the bottom side of the heat transfer tube 1, and kept in tight engagement with the bottom side of the radiation fin set 2 and also in close contact with a heat source. The heat source can be, for example, a CPU. According to this embodiment, the heat source is the light emitting unit 5 of the LED lamp 10. The light emitting unit 5 comprises a LED substrate 4 and multiple series of LEDs (light emitting diodes). The light emitting unit 5 releases heat when emitting light. Further, as shown in FIGS. 2 and 3, the heat transfer panel 3 has a stepped flat member having multiple steps 31 and a plurality of mounting through holes 32 and 33 cut through the top and bottom sides for the fixation of the mounting holes 13 at the bottom side of the heat transfer tube 1 and the LED substrate 4.

The aforesaid heat transfer tube 1, radiation fin set 2 and heat transfer panel 3 are assembled together, forming the desired heat sink module. During application, the heat transfer panel 3 is kept in close contact with the heat source so that the heat transfer panel 3 and the heat transfer tube 1 transfer heat from the heat source to the radiation fins 21 of the radiation fin set 2 for quick dissipation to the outside open air. As illustrated, the heat sink module is installed in the LED lamp 10. During operation of the light emitting unit 5 of the LED lamp 10, the heat transfer panel 3 and the heat transfer tube 1 transfer heat from the LED substrate 4 of the light emitting unit 5 of the LED lamp 10 to the radiation fins 21 of the radiation fin set 2 for quick dissipation to the outside open air. Therefore, the luminance of the LED lamp 10 is enhanced.

The heat sink module can also be used to dissipate heat from any of a variety of other heat sources, for example, CPU. In this case, the heat transfer panel 3 is kept in close contact with the surface of the CPU to transfer heat from the CPU to the radiation fin set 2 for quick dissipation of heat.

The lamp holder 101, LED substrate 4 and light emitting unit 5 of the aforesaid LED lamp 10 are known in the art. However, because the heat sink module of the present invention has excellent heat dissipation efficiency, the light emitting unit 5 of the LED lamp 10 can be formed of a big number of LED series.

Figure 6:
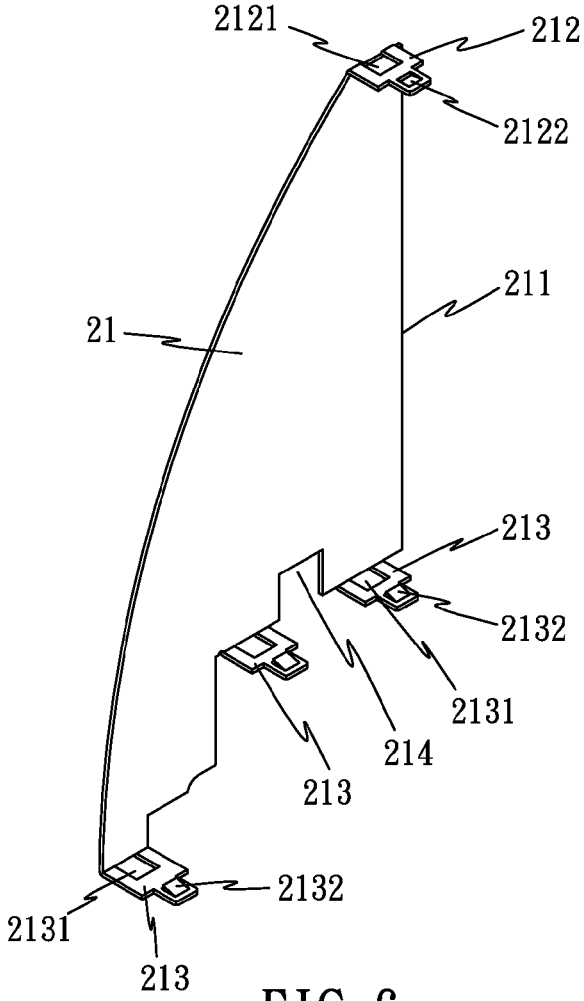
FIG. 6 is an elevational view of one radiation fin of the radiation fin set of the heat sink module according to the present invention.

Referring to FIG. 6, each radiation fin 21 of the radiation fin set 2 has retaining lugs 212 and 213 respectively protruding from the top and bottom sides. By means of the retaining lugs 212 and 213, the radiation fins 21 are fastened together, as shown in FIG. 2. The retaining lugs 212 and 213 each have a retaining hole 2121 or 2131, and a hooked block 2122 or 2132 protruding from the top or bottom side. By means of engaging the hooked blocks 2122 and 2132 of one radiation fin 21 into the retaining holes 2121 and 2131 of another radiation fin 21, the radiation fins 21 are fastened together.

Further, the bottom retaining lugs 213 are arranged to fit the configuration of the multiple steps 31 of the heat transfer panel 3. The notch 214 on the bottom side of each radiation fin 21 facilitates installation of screws 41 that affix the LED substrate 4 to the heat transfer panel 3. Besides the fastening function, the retaining lugs 212 and 213 increase the contact area between the radiation fins 21 and the heat transfer panel 3, enhancing heat transfer efficiency. Further, a transmissive cover plate 6 may be fastened to the bottom side of the radiation fin set 2 and the heat transfer panel 3.

Figure 7:
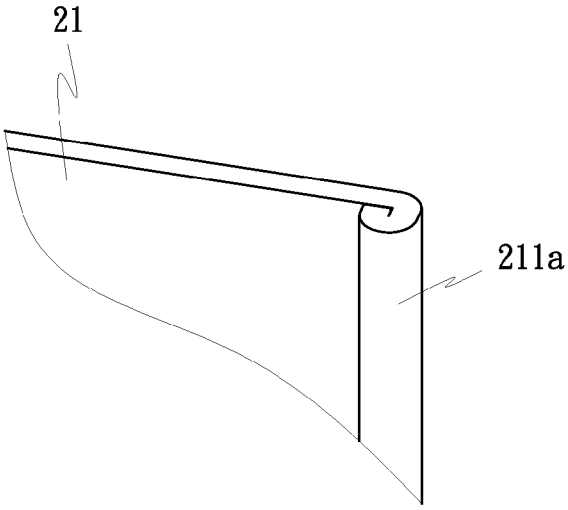
FIG. 7 is a schematic drawing showing a ribbed end edge formed on the inner end of the radiation fin according to the present invention.
Figure 8:
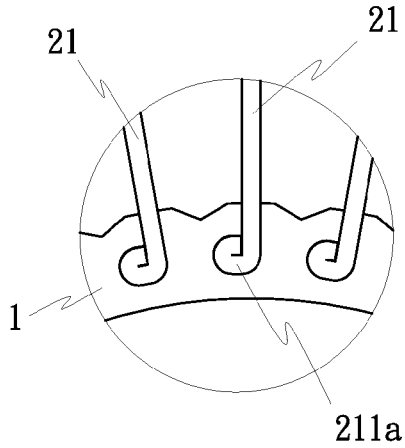
FIG. 8 is a schematic drawing showing the ribbed end edge of the radiation fin of FIG. 7 fastened to the heat transfer tube.

Referring to FIGS. 7 and 8, each radiation fin 21 has its inner end ribbed into a ribbed end edge 211*a* for engaging into one respective locating groove 11 on the periphery of the heat transfer tube 1, enhancing the connection tightness between the radiation fins 21 and the heat transfer tube 1 and increasing the contact area between the radiation fins 21 and the heat transfer tube 1.

Figure 9:
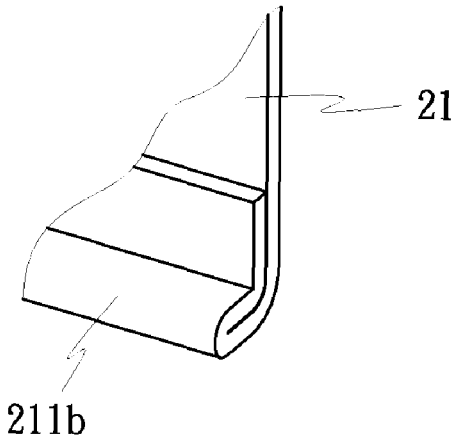
FIG. 9 is a schematic drawing showing another form of ribbed end edge formed on the inner end of the radiation fin according to the present invention.
Figure 10:
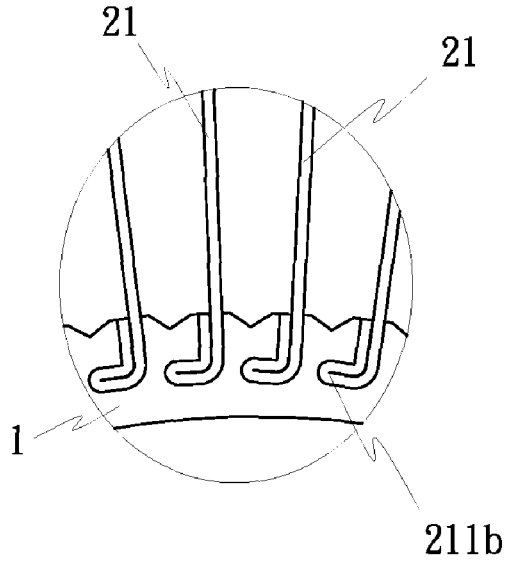
FIG. 10 is a schematic drawing showing the ribbed end edge of the radiation fin of FIG. 9 fastened to the heat transfer tube.
Figure 11:
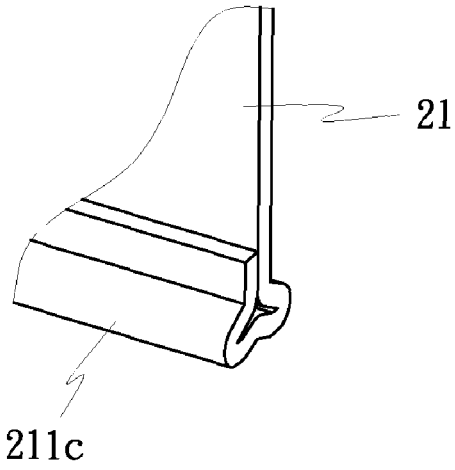
FIG. 11 is a schematic drawing showing still another form of ribbed end edge formed on the inner end of the radiation fin according to the present invention.
Figure 12:
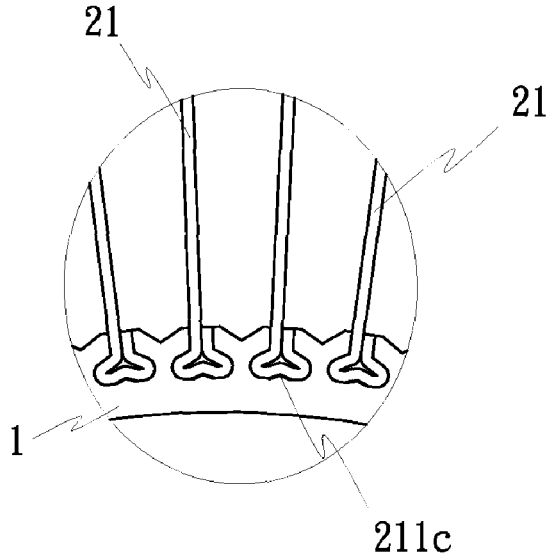
FIG. 12 is a schematic drawing showing the ribbed end edge of the radiation fin of FIG. 11 fastened to the heat transfer tube.
Figure 13:
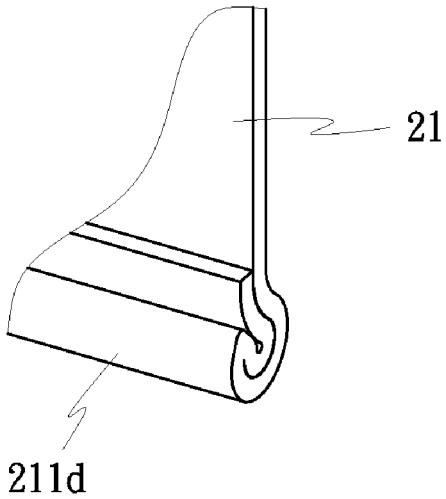
FIG. 13 is a schematic drawing showing still another form of ribbed end edge formed on the inner end of the radiation fin according to the present invention.
Figure 14:
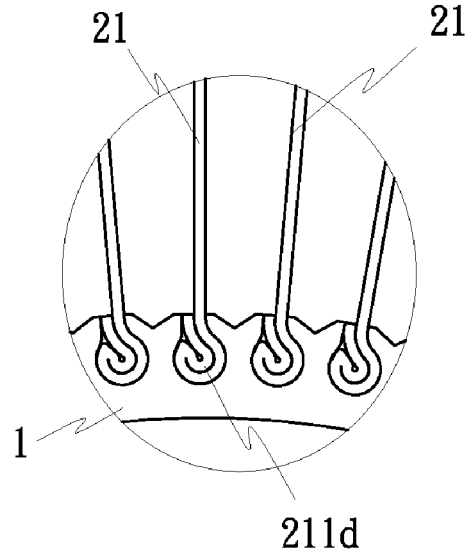
FIG. 14 is a schematic drawing showing the ribbed end edge of the radiation fin of FIG. 13 fastened to the heat transfer tube.
Figure 15:
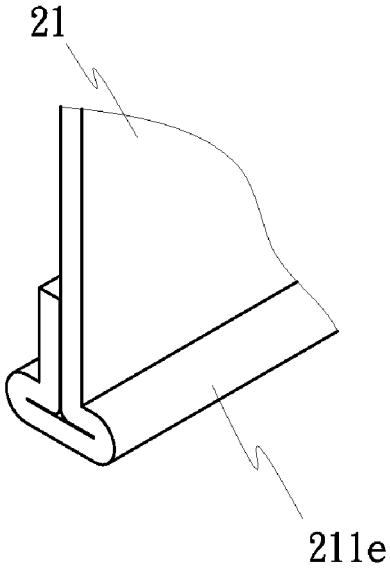
FIG. 15 is a schematic drawing showing still another form of ribbed end edge formed on the inner end of the radiation fin according to the present invention.
Figure 16:
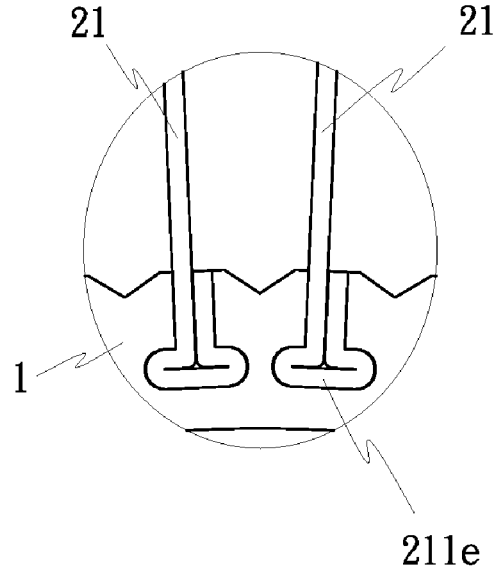
FIG. 16 is a schematic drawing showing the ribbed end edge of the radiation fin of FIG. 15 fastened to the heat transfer tube.

The ribbed end edge 211*a* can be made in any of a variety of shapes. In the example shown in FIGS. 9 and 10, the ribbed end edge 211*b* has an L-shaped profile. In the example shown in FIGS. 11 and 12, the ribbed end edge 211*c* has a triangular profile. In the example shown in FIGS. 13 and 14, the ribbed end edge 211*d* has a scrolled profile. In the example shown in FIGS. 15 and 16, the ribbed end edge 211*e* has an inverted T profile.

Further, a metal extrusion process can be employed to make the heat transfer tube 1 having the locating grooves 11 and V-grooves 12 alternatively arranged around the periphery. The metal extrusion process is suitable for mass production to lower the manufacturing cost of the heat transfer tube 1.

Figure 17:
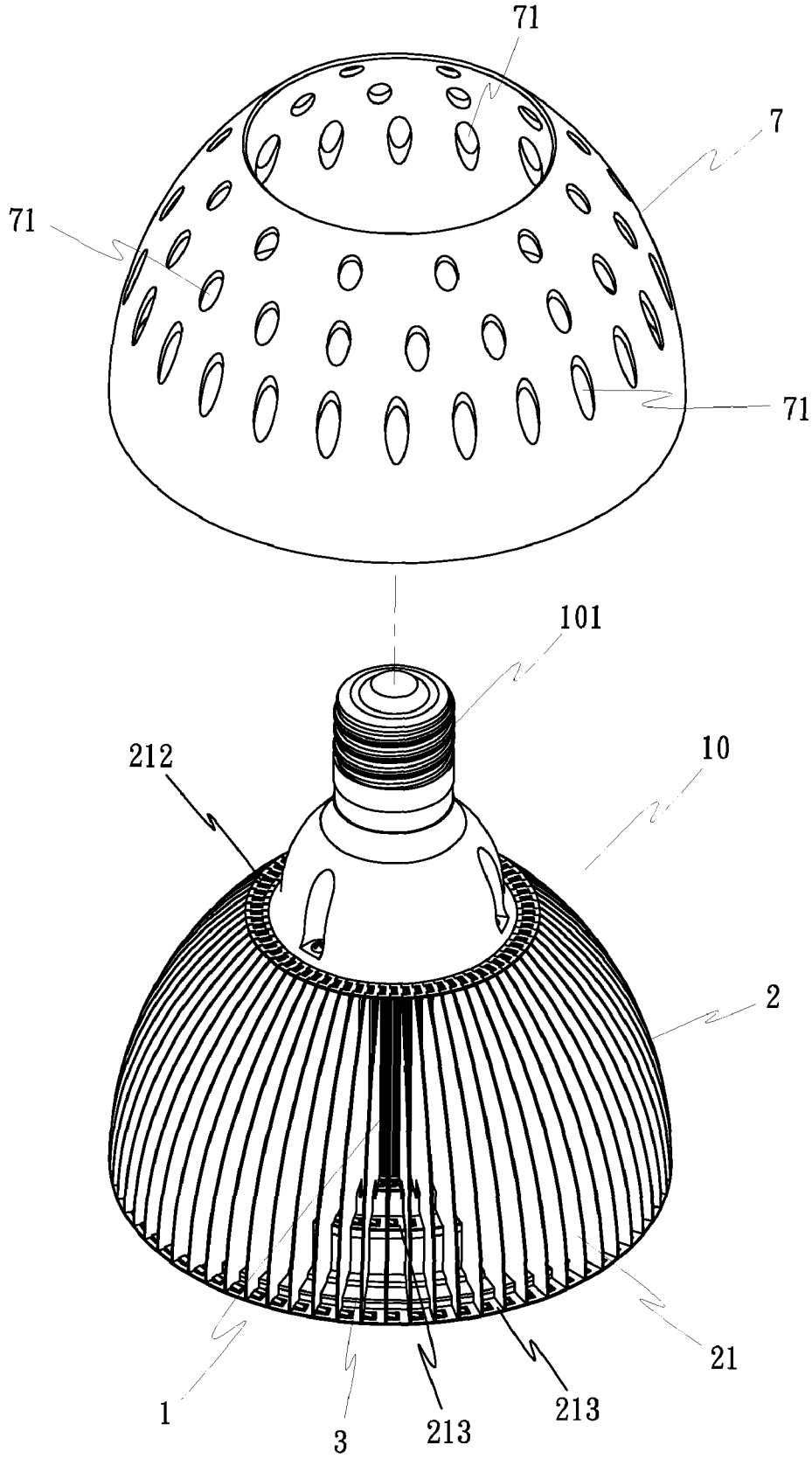
FIG. 17 corresponds to FIG. 1, showing the LED lamp used with an outer shell before loading of the outer shell.
Figure 18:
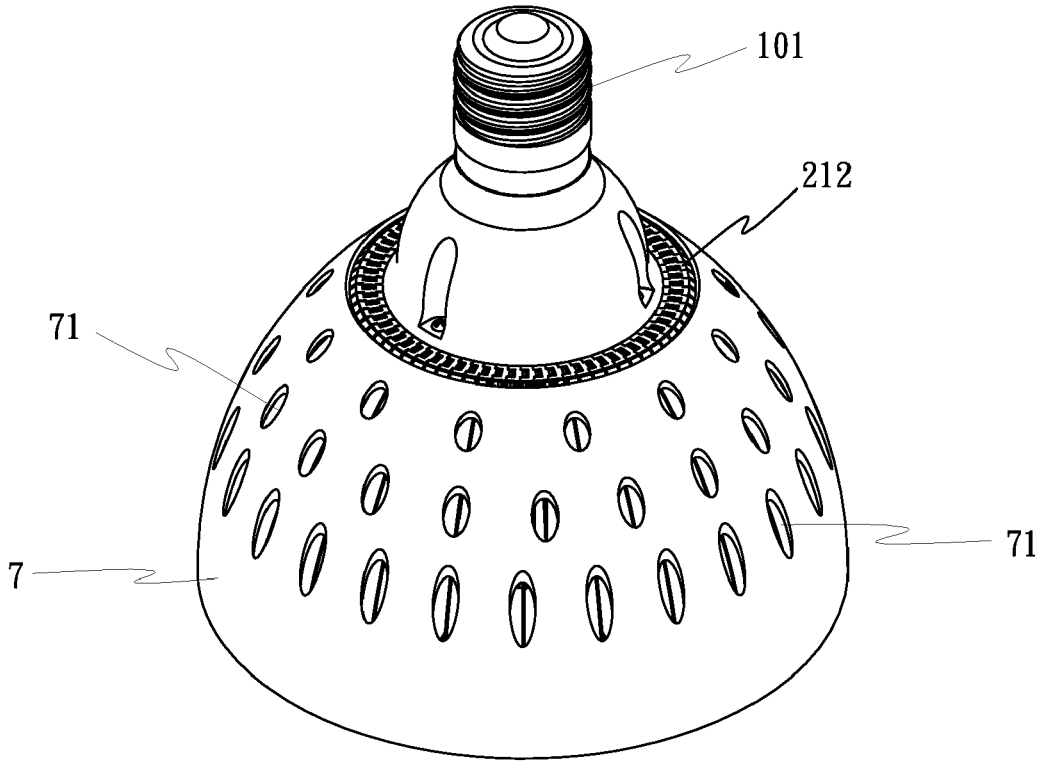
FIG. 18 corresponds to FIG. 17, showing the outer shell capped on the radiation fin set.

Referring to FIGS. 17 and 18, an outer shell 7 is capped on the radiation fin set 2. The cup-like lampshade 7 has a plurality of air vents 71 for dissipation of heat.

Figure 19:
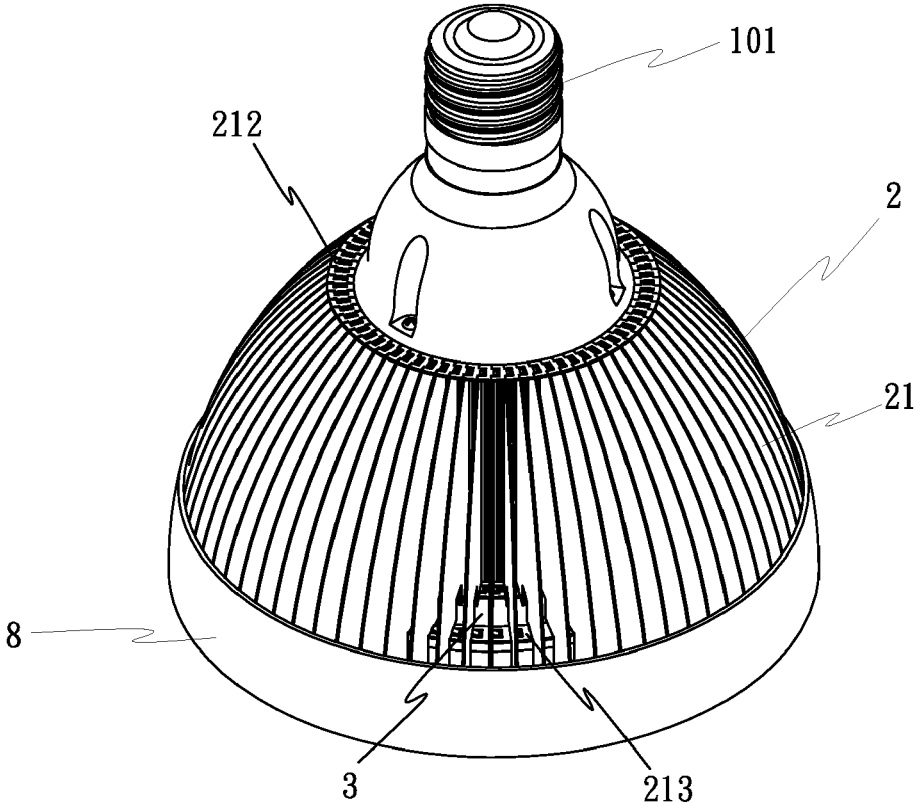
FIG. 19 is similar to FIG. 1 but showing a ring-shaped outer shell fastened to the bottom side of the radiation fin set.

FIG. 19 shows an alternate form of the outer shell, referenced by 8. According to this embodiment, the outer shell 8 is a simple ring capped on the periphery of the radiation fin set 2 at the bottom side.

Further, a solid cylindrical heat transfer member can be used to substitute for the heat transfer tube, i.e., the heat transfer tube can be made in a hollow form or solid form. Further, the heat transfer tube can have a circular, triangular, rectangular or polygonal cross section. Further, the size and shape of the radiation fins and their arrangement are not limited to the aforesaid description, i.e., various modifications and enhancements may be made without departing from the spirit and scope of the invention. Accordingly, the invention is not to be limited except as by the appended claims.

What is claimed is:

1. A heat sink module, comprising:

a heat transfer tube, said heat transfer tube comprising a plurality of locating grooves equiangularly spaced around the periphery thereof;

a radiation fin set, said radiation fin set comprising a plurality of radiation fins respectively fastened to the locating grooves of said heat transfer tube, each said radiation fin comprising a plurality of retaining lugs respectively protruding from top and bottom sides thereof, the retaining lugs of one said radiation fin being respectively fastened to the retaining lugs of another said radiation fin; and a heat transfer panel affixed to a bottom side of said heat transfer tube for direct contact with a heat source to transfer heat to said heat transfer tube and said radiation fin set for dissipation, wherein said heat transfer panel is a stepped flat panel; each said radiation fin of said radiation fin set has a plurality of said retaining lugs arranged at the bottom side thereof at different elevations to fit the stepped configuration of said heat transfer panel.

2. The heat sink module as claimed in claim 1, wherein said heat transfer tube, said heat transfer panel and said radiation fins of said radiation fin set are made of a heat conducting metal material selected from a material group including copper and aluminum.

3. The heat sink module as claimed in claim 1, wherein said heat transfer tube further comprises a plurality of V-grooves respectively formed on the periphery thereof between each two adjacent locating grooves, said V-grooves being deformable by an external force to cause deformation of said locating grooves after insertion of said radiation fins into said locating grooves.

4. The heat sink module as claimed in claim 1, wherein said heat transfer tube comprises a plurality of mounting holes formed on top and bottom sides of an inside wall thereof.

5. The heat sink module as claimed in claim 1, wherein said heat transfer tube has a top side thereof mounted with a lamp holder; said heat transfer panel carries a heat source, which is a light emitting device comprising a LED substrate and a plurality of light emitting diodes.

6. The heat sink module as claimed in claim 1, wherein each said retaining lug of each said radiation fin comprises a retaining hole and a hooked block, and the retaining holes of the retaining lugs of each said radiation fin are respectively engaged with the hooked blocks of the retaining lugs of another radiation fin.

7. The heat sink module as claimed in claim 1, wherein each said radiation fin has a ribbed inner end edge respectively fastened to the locating grooves of said heat transfer tube.

8. The heat sink module as claimed in claim 1, wherein said heat transfer tube is extruded from a metal material.

9. The heat sink module as claimed in claim 1, wherein said radiation fin set has the periphery thereof mounted with an outer shell.

* * * * *